United States Patent [19]

Lonati

[11] Patent Number: 4,567,737

[45] Date of Patent: Feb. 4, 1986

[54] DEVICE FOR ADJUSTING LOOP DENSITY IN A CIRCULAR KNITTING MACHINE

[75] Inventor: Francesco Lonati, Brescia, Italy

[73] Assignee: Lonati S.p.A., Brescia, Italy

[21] Appl. No.: 474,928

[22] Filed: Mar. 14, 1983

[30] Foreign Application Priority Data

May 10, 1982 [IT] Italy ..... 21815/82[U]

[51] Int. Cl.[4] ..... D04B 15/32

[52] U.S. Cl. ..... 66/55

[58] Field of Search ..... 66/26, 54, 55, 70, 71, 66/77, 27

[56] References Cited

U.S. PATENT DOCUMENTS

| | | | |
|---|---|---|---|
| Re. 24,239 | 11/1956 | Stack | 66/55 |
| 2,534,460 | 12/1950 | Lawson et al. | 66/55 X |
| 3,232,079 | 2/1966 | Levine et al. | 66/55 X |

FOREIGN PATENT DOCUMENTS

| | | | |
|---|---|---|---|
| 26425 | 4/1981 | European Pat. Off. | 66/55 |
| 2033499 | 1/1972 | Fed. Rep. of Germany | 66/54 |
| 2153429 | 5/1973 | Fed. Rep. of Germany | 66/77 |
| 2421464 | 1/1975 | Fed. Rep. of Germany | 66/55 |
| 2631858 | 2/1977 | Fed. Rep. of Germany | 66/55 |
| 1145977 | 5/1957 | France | 66/55 |
| 701189 | 2/1966 | Italy | 66/55 |

*Primary Examiner*—Wm. Carter Reynolds

*Attorney, Agent, or Firm*—Guido Modiano; Albert Josif

[57] ABSTRACT

For adjusting loop density in a circular knitting machine there is provided a step motor arranged below the needle cylinder and having a threaded shaft threadably engaging one end of a lever pivoted to a stationary structure of the machine. The free end of the threaded shaft abuts against a rotatable stop supported by the stationary portion of the machine, and the housing of the motor is prevented from rotating with respect to the lever. The opposed end of this lever supports a cylinder holder. Rotation of the threaded shaft of the step motor which is controlled by a programming member causes a pivotal movement of the lever and thus a raising or lowering movement of the needle cylinder to vary the loop density.

5 Claims, 5 Drawing Figures

DEVICE FOR ADJUSTING LOOP DENSITY IN A CIRCULAR KNITTING MACHINE

BACKGROUND OF THE INVENTION

This invention relates to a device for adjusting the loop density in a circular knitting machine, in particular a hose knitting machine.

The above adjustment, as is known, is effected by shifting the needle cylinder vertically with respect to the plane of formation of the loops or to the cam assemblies, so that shorter or longer loops can be formed. The cylinder, which can be shifted axially with respect to the cylinder holder, bears through load bearing rods onto a thrust bearing, in turn supported by a forked end of a lever. This lever is pivoted centrally to the stationary structure of the machine, and has an opposed end in abutment relationship with the middle portion of an adjustment rod, the latter being pivoted with one end onto the machine stationary structure and abutting with the other end a stationary portion of the machine. The rod can be displaced from its inoperative or home position by the action of cams provided on the machine main drum, which through small control levers, can act on the free end of respective levers, which will shift accordingly, and as required, the adjustment rod out of its home position. Thus, the adjustment of the needle cylinder height, and hence of the loop density, is accomplished during the progressive rotation of the main drum.

Such prior devices have the disadvantage of a complex mechanical construction, which requires a high number of levers, and of consequence considerable space in the machine and over the main drum. Moreover, the operator or erector must display remarkable skill and sensitivity in tuning the machine, in that he has to manipulate a high number of adjusting screws, which may readily result in an inaccurate adjustment. Owing to machining tolerances and the multiple levers interposed between the main drum and cylinder, such devices are unsuitable for standard series tuning, and each machine must be tuned on an individual basis.

SUMMARY OF THE INVENTION

It is a primary object of this invention to provide a device for adjusting the loop density in a circular knitting machine, in particular a hose knitting machine, which can significantly simplify the machine tuning operations by an operator or erector, has a simpler and more compact construction than prior devices, and provides a more reliable tuning, particularly where a set of machines intended to carry out one and the same style of knitting are being handled.

This and other objects, such as will be apparent from the description which follows, are achieved by a device for adjusting the loop density in a circular knitting machine, in particular a hose knitting machine, which comprises a needle cylinder movable axially with respect to a needle cylinder holder and supported through one end of a lever pivoted at a middle point thereof to the machine stationary structure, the other end of said lever being adapted to be shifted under control by the machine for the purpose of adjusting the loop density, and is characterized in that for shifting said other end of said lever, a step motor is provided the output shaft whereof, which is at least partly threaded, engages with a threaded bore formed at said other end and abuts against a portion of the machine stationary structure, said step motor receiving control pulses from a machine programming member.

In a device of this type, therefore, all that part of the machine which includes the levers controlled by the machine drum is eliminated, and the drum is left available for other controls, or alternatively, may be smaller in size. In addition to a reduction in space requirements, the capability is secured of providing an electronically controlled form of more accurate and reliable tuning.

BRIEF DESCRIPTION OF THE DRAWINGS

Further features and advantages of the invention will be apparent from the following description in conjunction with the accompanying drawings, where.

DESCRIPTION OF A PREFERRED EMBODIMENT

Figures 1, 5:
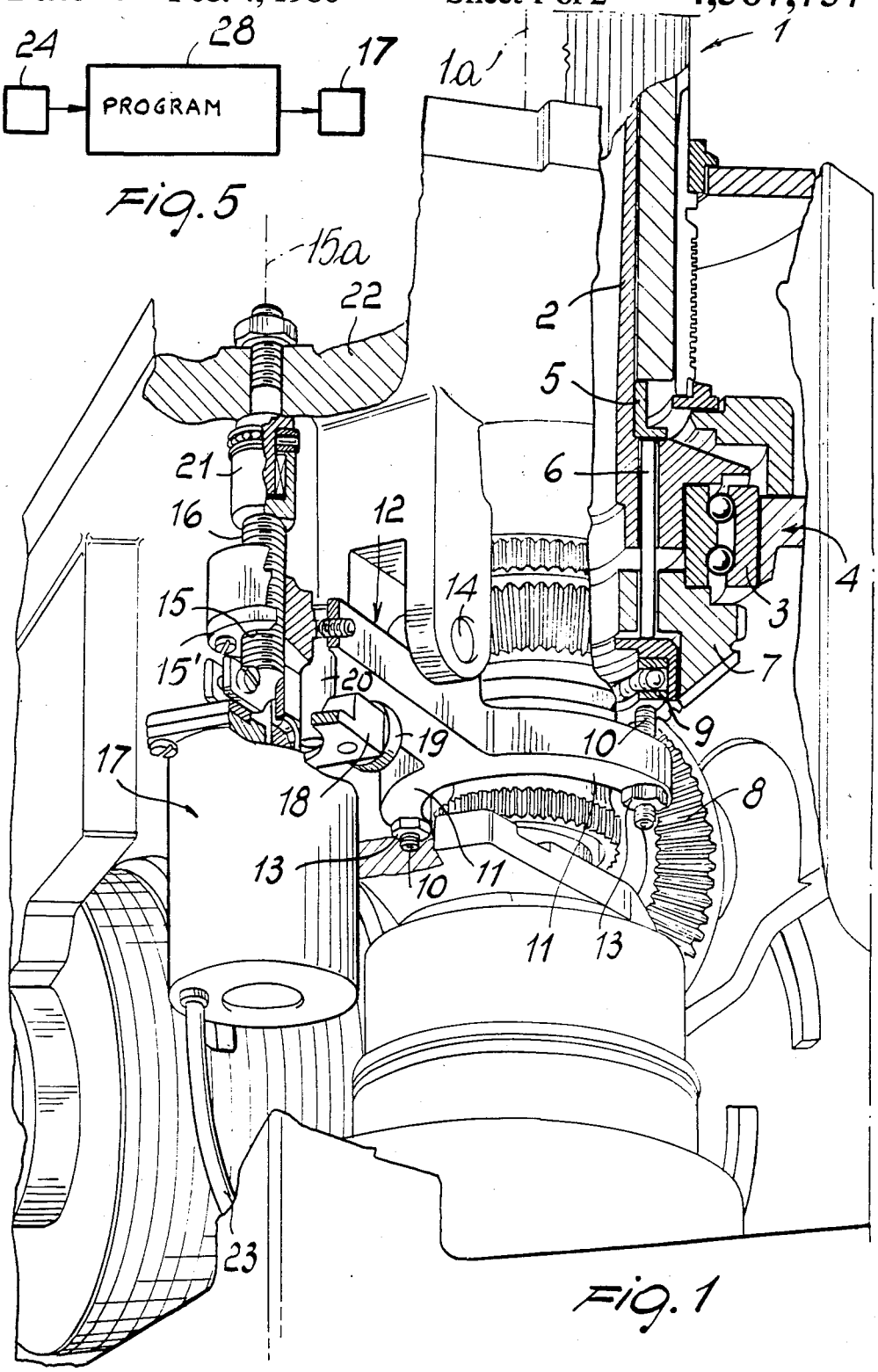
FIG. 1 is a partly cutaway perspective view of a device according to the invention as incorporated to a single-cylinder circular hose knitting machine.
FIG. 5 shows schematically the programming member arranged to supply control pulses to the step motor in accordance with the number of knitted courses (cylinder revolutions).

In the accompanying drawings the inventive device is incorporated in a circular hose knitting machine including a needle cylinder 1 defining a cylinder axis 1*a*, which is carried for axial movement on a needle cylinder holder 2, in turn rotatably supported, through bearings 3, by a stationary structure 4. The cylinder 1 bears onto a flanged ring 5, supported by load-bearing rods 6 which extend through the cylinder holder 2 and a bevel gear wheel 7. The latter is rotatively driven through a drive bevel gear wheel 8 and transmits the motion to the cylinder holder 2 through the rods 6.

Figure 2:
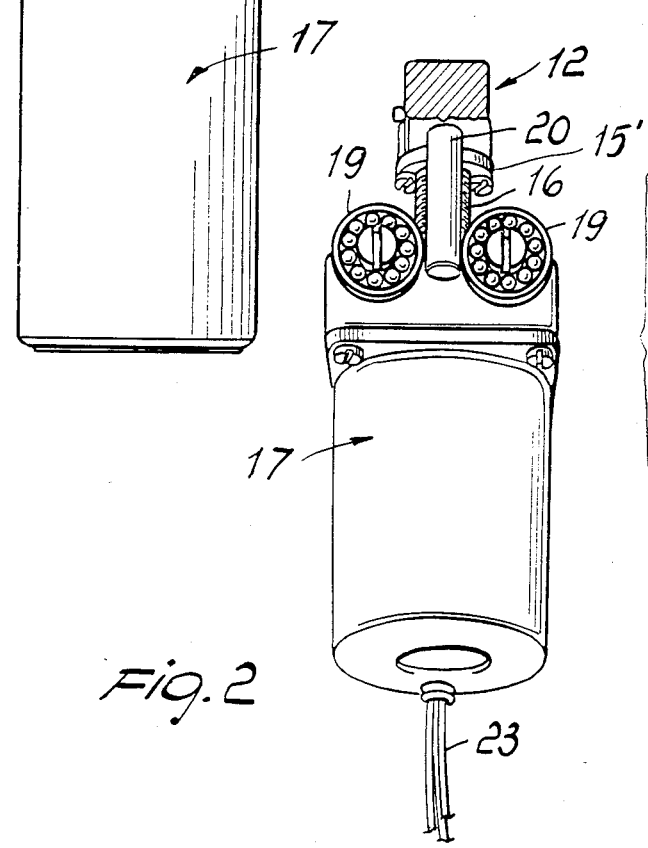
FIG. 2 is a fragmentary sectional view according to Line II—II of FIG. 3.

The rods 6 are supported by a thrust bearing 9 accommodated below the bevel gear 7. In turn, the bottom race of the bearing 9 bears on threaded adjustment stops 10, which are threaded into respective arms 11 of a forked end of a lever 12. The adjustment stops 10 are locked on the lever 12 by means of locknuts 13. The lever 12 is pivoted, at a middle point thereof, to the stationary structure at 14, and has another end where a threaded hole 15 is provided, e.g. either formed through the lever itself (FIG. 3) or through an element 15' rigid with the lever (FIGS. 1 and 2), in which case said end would be simply drilled to a larger diameter than the threaded hole 15.

With the threaded hole or bore 15 defining a screwing action axis 15*a*, there engages a threaded output shaft 16 of a step motor 17 which is carried on the lever 12 through its threaded shaft 16. The housing of the motor 17 is carried on the lever 12 in a non-rotatable manner, and is provided to this aim, for example, with a flange 18, on which two roller bearings 19 are mounted laterally, to define a gap therebetween wherein a guiding peg 20 attached to the lever 12 is allowed to slide and exert a guiding action. The motor 17 may be, for example, of the R.D.M.-S 69/50 type, manufactured by Berger of Lahr (W. Germany).

Figure 3:
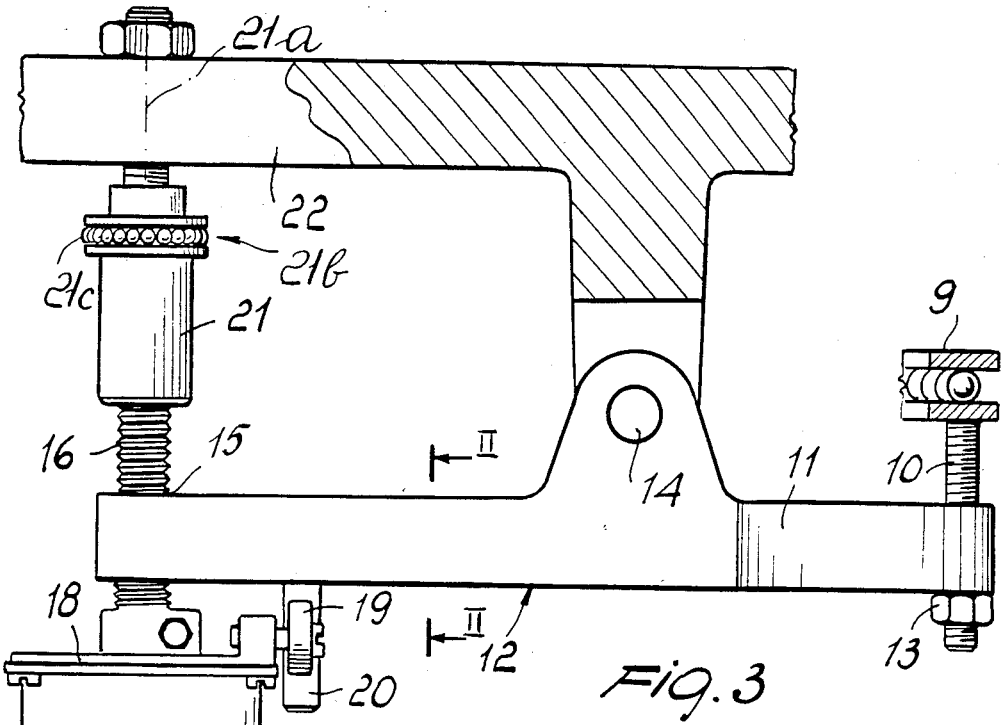
FIG. 3 is a fragmentary side view of the device of FIG. 1 in which a modification of a detail is shown.

The shaft 16, which may also be only partly threaded, abuts with its free end against the base or bottom of a small abutment cylinder 21 which is supported rotatably about an axis 21*a* by the portion 22 of the stationary portion 4 of the machine through swivel means 21*b*, of which the ball bearing race ring 21*c* is coaxial with shaft 16, as best visible in in FIG. 3 of the drawing. Thus the frictional resistance generated by the rotating shaft 16 can be minimized.

Figure 4:
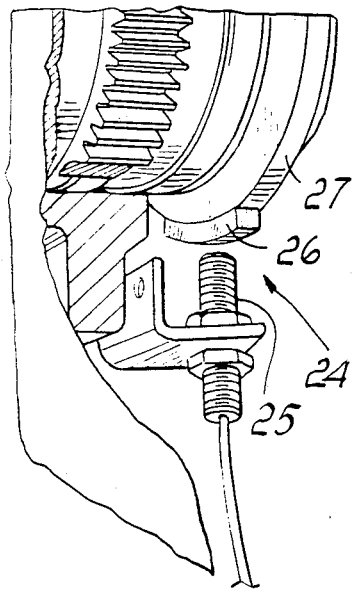
FIG. 4 is a detail view of the motor control means.

The step motor 17 is controlled, through leads 23, by the machine program. In particular, a tachometer or revolution counter device 24 (FIG. 4) is provided which comprises, for example, a proximity switch 25 operative to detect the number of passes of a magnetic body 26, attached to a disk 27 arranged to rotate with the cylinder 1 with a 1:1 speed ratio. The proximity switch 25 may be, for example, of the B 12/2 type manufactured by Ditta Selet of Turin (Italy).

The pulses detected as the magnetic body 26 moves past, which are linked to the number of knitting courses completed by the machine in a fixed ratio, are supplied to a programming member 28 (FIG. 5), which counts them and upon reaching certain values, as set by the knitting program, controls the step motor 17 to rotate through a certain angle in either direction. It will be understood from the foregoing that the step motor is a selectively controlled step motor. The programming member 28 may be, as an example, of the microprocessor type, substantially as described in the European Published Application No. 0026425 of May 13, 1981 by Costruzioni Meccaniche Lonati S.p.A.

It will be understood that the rotation of the threaded shaft 16 in either direction involves displacement of the associated end of the lever 12 upwards or downwards, with consequent lowering or raising of the cylinder 1 with respect to the cylinder holder 2 and cam assembly. The extent of said displacement will depend on the rotation angle or r.p.m. of the shaft 16, and hence on the number of pulses supplied to the motor 17 by the programming member 28. Since the motor 17 is supported by the lever 12, there occurs no malfunction or critical friction between the threaded shaft 16 and lever 12 due to the relative displacement therebetween, because the motor 17 is always held with its axis perpendicular to the lever 12. Furthermore, the bearings 19 reduce the relative displacement friction since they roll onto the peg 20.

In an actual example, one revolution of the shaft 16 of the motor 17 may correspond to 1,000 pulses. Thus, a high adjustment fineness is achieved.

It will be appreciated from the foregoing description that a device according to the invention can do without most of the levers of prior devices, while making the machine tuning operations simpler to carry out by the operator or erector, since all of the adjusting screws have been virtually eliminated, excepting those supporting the thrust bearing 9.

By omitting the various levers and controls thereof through the drum, the latter is partly left available and can be utilized for other machine controls, or alternatively made smaller. Moreover, the inventive device makes it possible to program in exactly the same manner a set of machines for equal loop calibration values without manipulating adjusting screws on all the machines, which would hardly ensure perfectly identical results. With the device of this invention, the traditional ankle narrowing cam can also be omitted.

I claim:

1. A device for adjusting loop density in a circular knitting machine, particularly a hose knitting machine, with a stationary structure and a needle cylinder defining a cylinder axis and axially movable with respect to a needle cylinder holder, the device comprising a lever pivoted at an intermediate point thereof to said stationary structure, the lever having one end thereof adapted to carry said needle cylinder and for axial actuation of said needle cylinder, said lever having another end thereof with first screw thread means defining a screwing action axis extending parallel to the direction of said cylinder axis, a selectively controllable step motor with an output shaft coaxial with said screwing action axis and having second screw thread means in screwing engagement with said first screw thread means, stationary abutment means on said stationary structure in axial abutting engagement with said output shaft to prevent axial movement thereof and allow relative rotation between said output shaft and said lever thereby allowing screwing action between said first screw thread means and said second screw thread means thereby to cause movement of said another end of said lever along said output shaft upon actuation of said step motor and consequent oscillation of said lever about the pivot point thereof to impart thereby axial movement to said needle cylinder through action of said one end of said lever.

2. A device according to claim 1, wherein said first screw thread means comprise an internally threaded hole.

3. A device according to claim 1, wherein said abutment means comprise an abutment cylinder carried rotatably on said stationary structure about an axis of rotation coaxial with said output shaft.

4. A device according to claim 1, wherein said first screw thread means in screwing engagement with said second screw thread means are adapted to support said step motor through said output shaft thereof and wherein said step motor comprises a housing including means for preventing relative rotation of said housing with respect to said lever.

5. A device according to claim 4, wherein said means for preventing relative rotation of said housing comprise a pair of spaced apart roller bearings defining a gap therebetween and mounted on said housing and a guiding peg extending through said gap and rigid with said lever thereby to allow said roller bearings to roll along said guiding peg while said another end of said lever is being shifted along said output shaft and simultaneously prevent said housing to rotate.

* * * * *